United States Patent [19]

Rebekale

[11] Patent Number: 4,856,397

[45] Date of Patent: Aug. 15, 1989

[54] ADHESIVE TAPE CUTTER

[76] Inventor: Arshaloos N. Rebekale, 3740 La Crescenta Ave., Glendale, Calif. 91208

[21] Appl. No.: 169,170

[22] Filed: Mar. 11, 1988

Related U.S. Application Data

[63] Continuation of Ser. No. 871,522, Jun. 6, 1986, abandoned.

[51] Int. Cl.[4] ..... B26D 1/62

[52] U.S. Cl. ..... 83/322; 83/339; 83/649; 83/922

[58] Field of Search ..... 83/310, 334, 335, 339, 83/346, 347, 649, 922, 322

[56] References Cited

U.S. PATENT DOCUMENTS

| | | | |
|---|---|---|---|
| 2,274,623 | 2/1942 | Hawkins | 83/322 |
| 2,298,360 | 10/1942 | Fitch | 83/922 X |
| 2,444,019 | 6/1948 | Krueger | 83/922 X |
| 3,563,201 | 2/1968 | Smith | 83/649 X |
| 4,608,894 | 9/1986 | Lee et al. | 83/649 |

*Primary Examiner*—Donald R. Schran

[57] ABSTRACT

An adhesive tape cutter device is described. The device comprises a slotted wheel with plurality of slots and projections, adhesive tape is adhered to projections and it is unrolled and pulled over the slotted wheel. A concavity is formed on each projection. A bladed wheel with plurality of blades interlocked to slotted wheel by means of four gears, one gear attached to slotted wheel, two gears are idle fourth gear is attached to bladed wheel, movement of bladed wheel enters one blade into a concavity of a projection of the slotted wheel cutting tape thereon. In second embodiment a blade attached to an arm and a roller following a route formed on one side of the slotted wheel respect to projections and large slots on the slotted wheel whereby movement of the slotted wheel moving roller attached arm and blade in and out of concavities of the projection cutting tape thereon. In third embodiment blade arm and roller assembly is suspended to device housing by a spring. A route is formed on one side of the slotted wheel relative to projections and large slots on the slotted wheel whereby movement of the slotted wheel moving roller arm and blade in and out of concavities of the projections cutting tape thereon.

1 Claim, 5 Drawing Sheets

FIG. 4
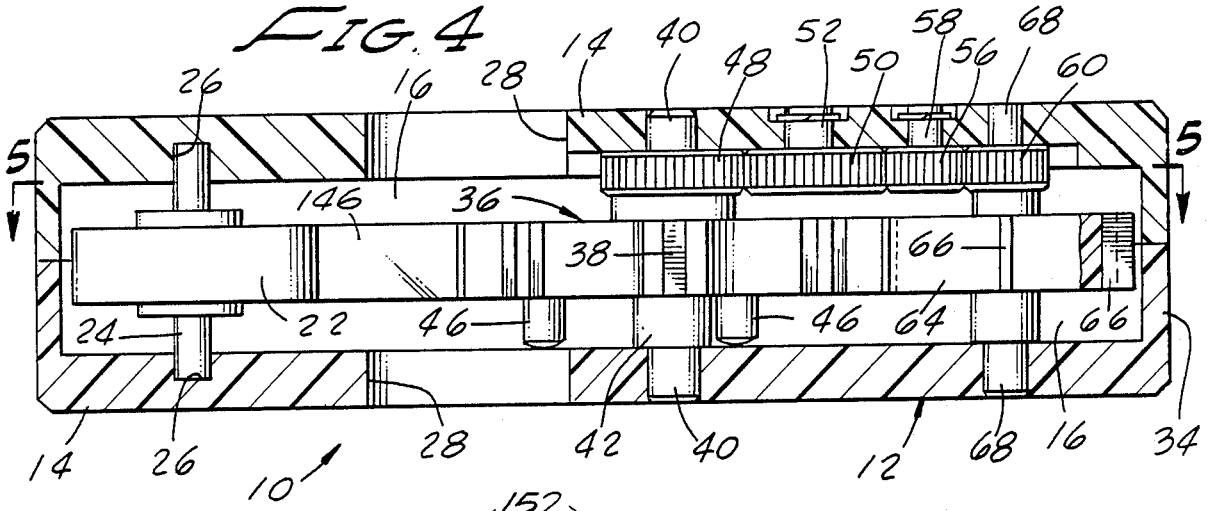
FIG. 5
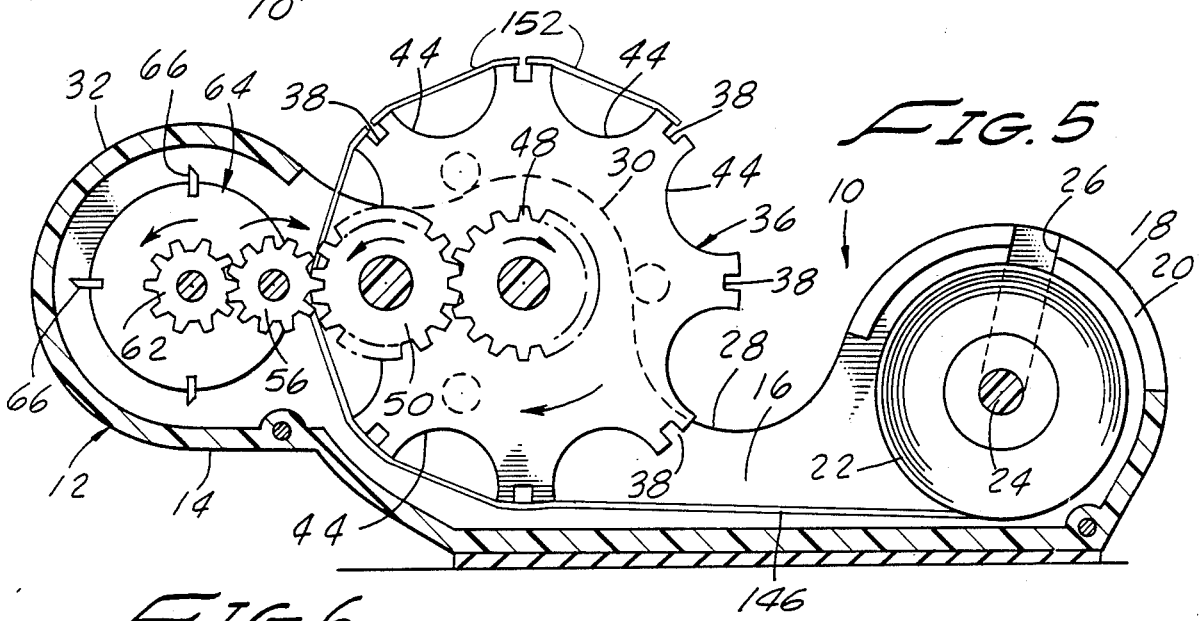
FIG. 6
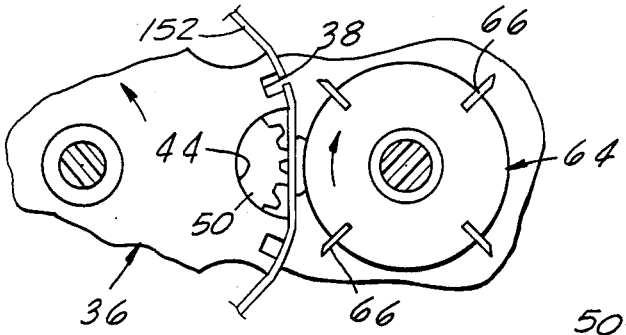
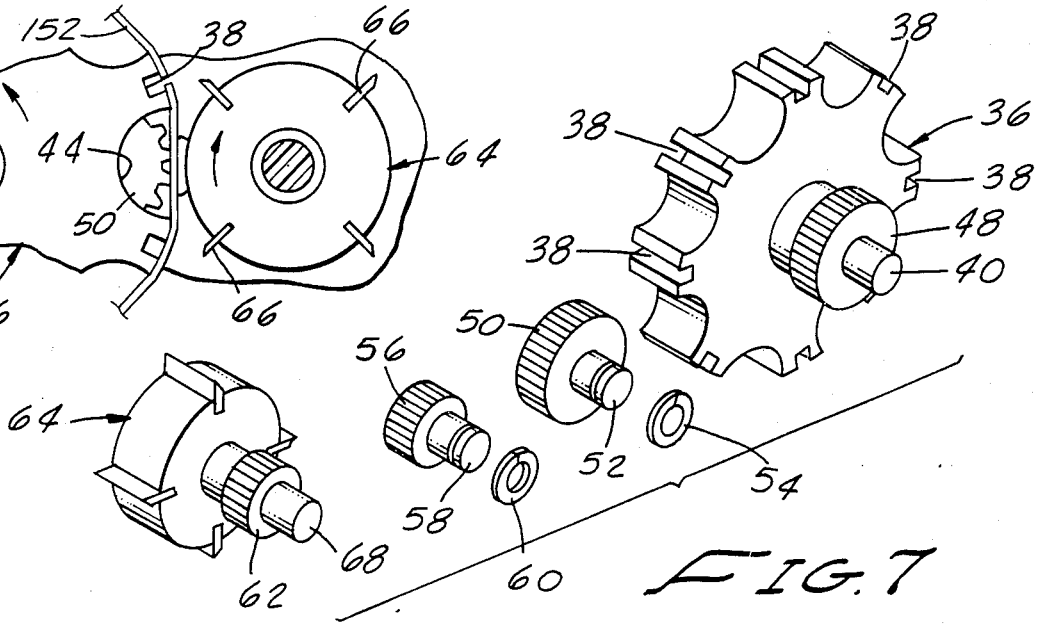
FIG. 7

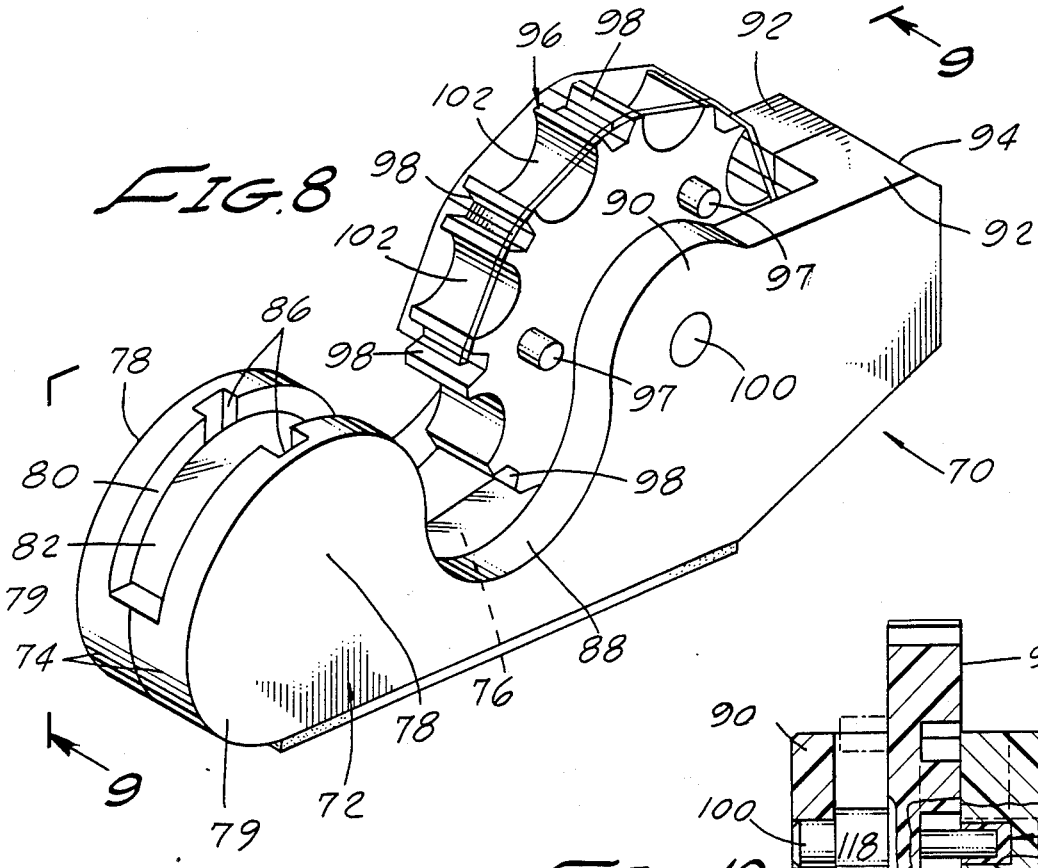
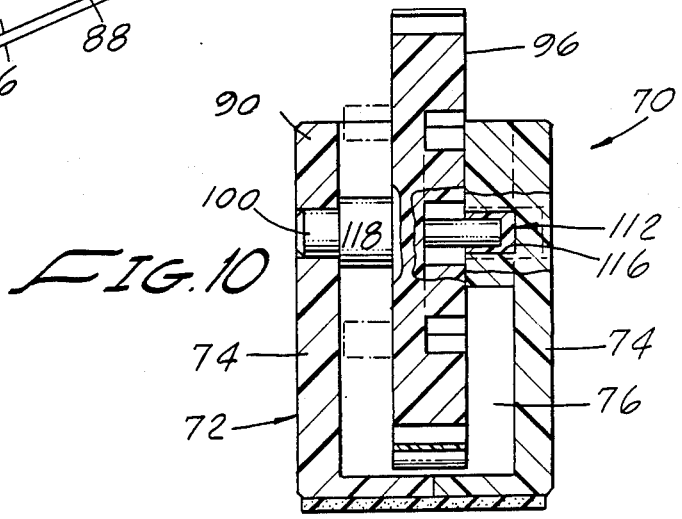
FIG. 10
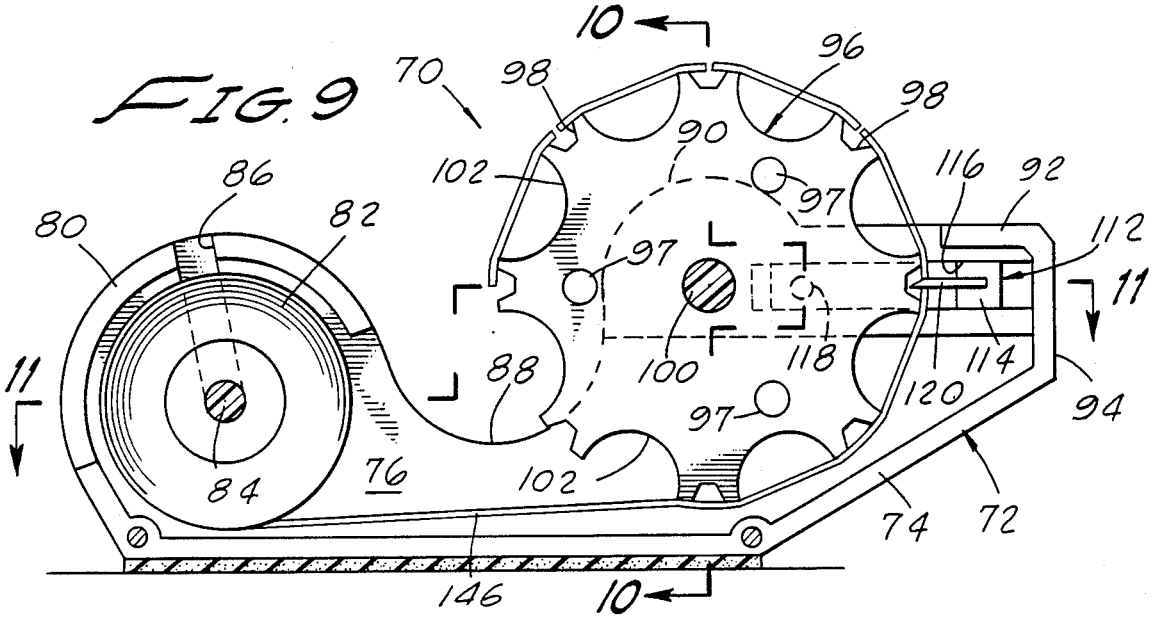

FIG. 11
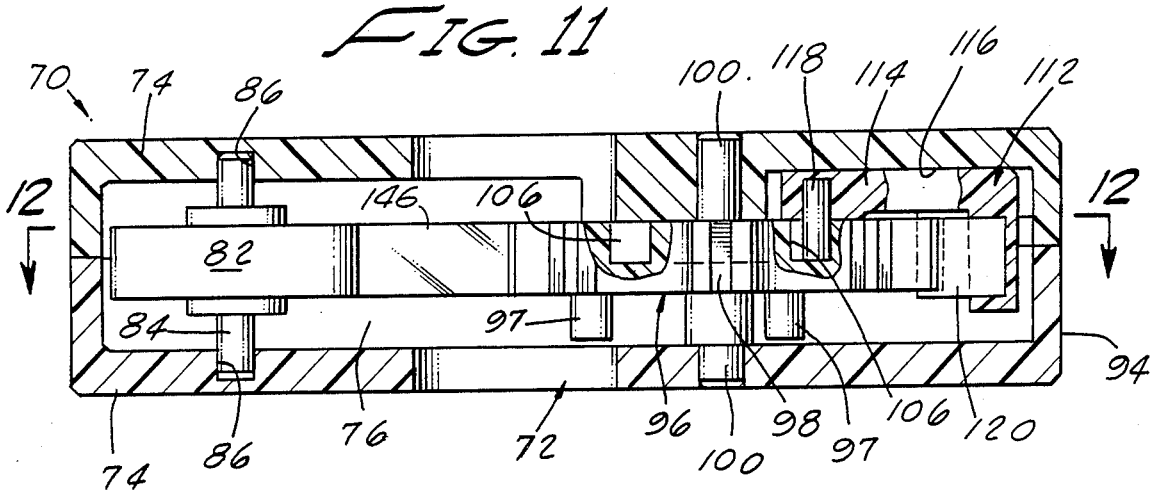
FIG. 12
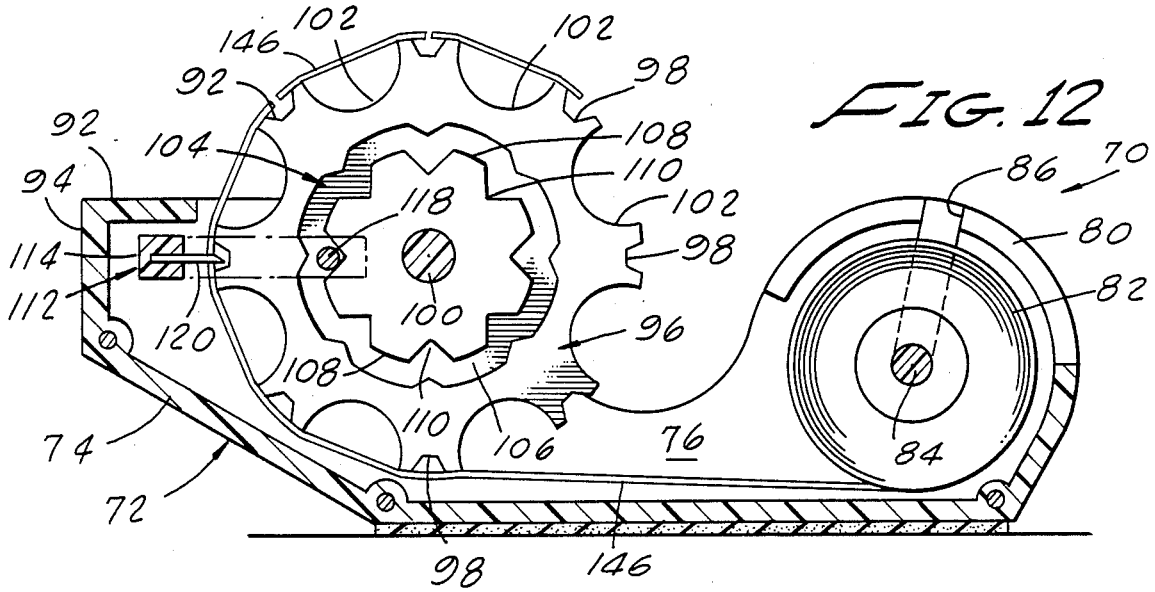
FIG. 13
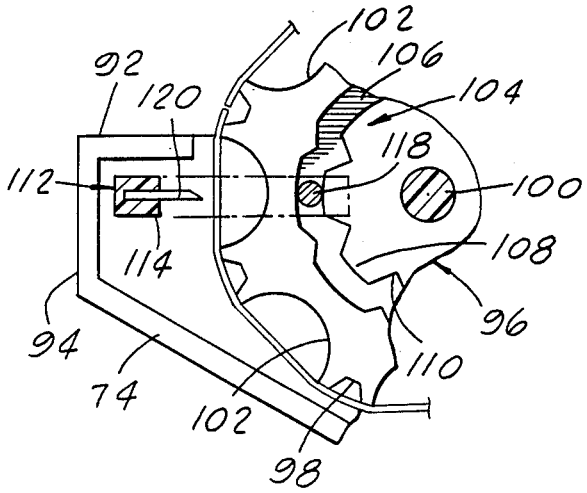
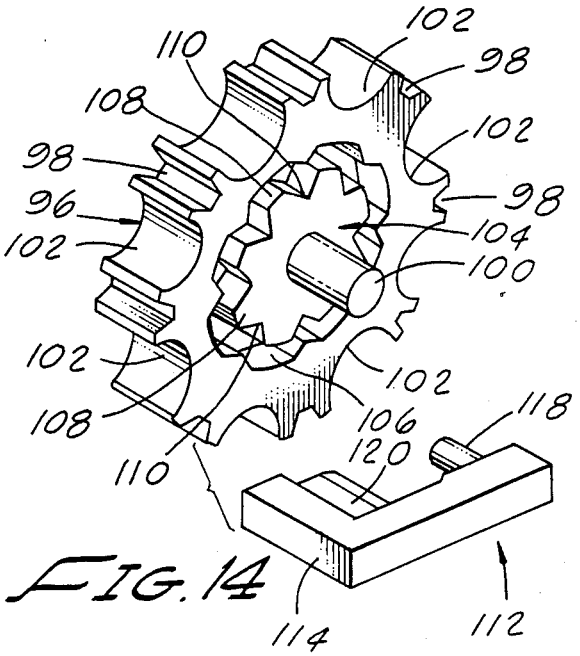
FIG. 14

ADHESIVE TAPE CUTTER

This application is a continuation, of application Ser. No. 871,522, filed 06/06/86 now abandoned.

SUMMARY OF INVENTION

This invention relates to an adhesive tape cutter and provides an adhesive tape cutter with a new and improved combination of elements that facilitates cutting of adhesive tape. The present invention dispenses with complicated apparatus disclosed in U.S. Pat. Nos. 2,326,916; 2,326,917; and 3,340,757. The devices disclosed in these patents require numerous parts and are relatively difficult to construct and operate.

The present invention provides an adhesive tape cutter device with relatively few parts which are relatively easy to produce, assemble, and use.

The invention has several embodiments, each having a housing enclosing a tape supply wheel or pulley, a slotted wheel with indentations to accommodate a person's finger, and cutting means for the adhesive tape.

The cutting means of one embodiment of the invention comprises a cutter wheel with a plurality of spaced cutters on its rim located in the housing adjacent to the slotted wheel. Another embodiment employs a cutter assembly located within the housing adjacent to the slotted wheel and provided with a blade. A still further embodiment of the invention modifies the structure of the cutter assembly and uses spring means for its operation.

It is, therefore, an object of the invention to provide an adhesive tape cutter with a capability of cutting adhesive tape in discrete and predetermined pieces.

Another object of the invention is to provide an adhesive tape cutter with relatively few and uncomplicated moving parts.

A further object of the invention is to provide an adhesive tape cutter which is relatively inexpensive and easy to manufacture and assemble.

A yet further object of the invention is to provide an adhesive tape cutter which is relatively easy to operate by a person's hand.

These and other objects will be more readily understood by reference to the following description and accompanying drawings, in which FIG. 1 is a perspective view of an embodiment of the invention.

FIG. 4 is a plan cross sectional view taken on lines 4—4 of FIG. 2.

FIG. 5 is a side elevational cross section taken on lines 5—5 of FIG. 4.

FIG. 6 is a partial fragmentary side view of the slotted wheel and cutter wheel of FIGS. 1–5.

FIG. 7 is an exploded perspective view of the gear transmission assembly of the preceding figures.

FIG. 8 is a perspective view of a second embodiment of the invention.

FIG. 9 is a side elevational cross section taken on lines 9—9 of FIG. 8.

FIG. 10 is a cross sectional view taken on lines 10—10 of FIG. 9.

FIG. 11 is a plan cross sectional view taken on lines 11—11 of FIG. 9.

FIG. 12 is a side elevational cross section taken on lines 12—12 of FIG. 11. FIG. 13 is a partial fragmentary side view of the slotted wheel and cutter assembly of FIGS. 8–12.

FIG. 14 is an exploded perspective view of the cutter assembly and slotted wheel of FIGS. 8 through 13.

Figure 1:
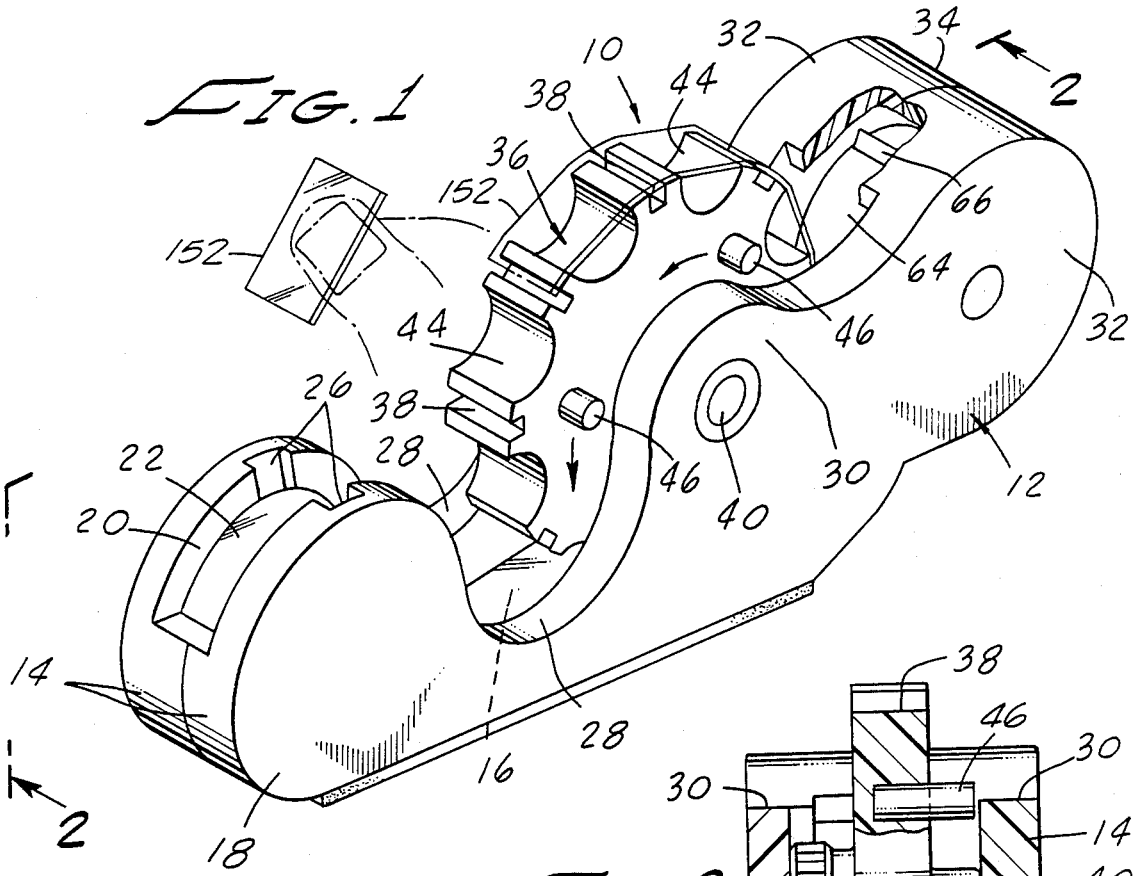
Figure 3:
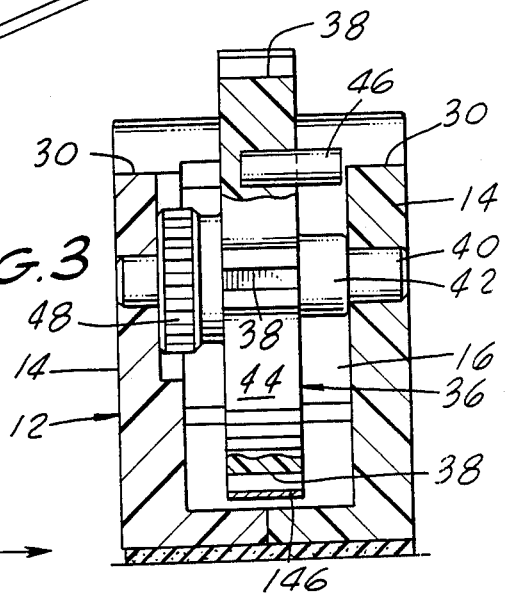
FIG. 3 is a cross sectional view taken on lines 3—3 of FIG. 2.

One embodiment 10 of the adhesive tape cutter invention has a housing 12 formed by two spaced side members 14, preferably identical in shape, that define a compartment 16 between them, and are joined together at each end by any suitable means.

Each of side members 14 has a semi-circular front portion 18 forming a front wall of housing 12 with a semi-circular recess formed in the interior walls of front portion 18 to accommodate a tape supply pulley 22 with spindles 24.

Each of the interior walls of front portion 18 of side members 14 has a vertical groove 26 opposite each other to permit the insertion of the tape supply pulley 22 and to provide a bearing surface for spindles 24. In back of and adjoining the front portion 18 are concavities 28 formed in the walls of side members 14.

In back of and adjoining the concavities 28 are a first set of partial semi-circular convexities 30 formed in the walls of side members 14.

A second set of partial semi-circular convexities 32 formed in the walls of side members 14 adjoin the first set and provide a rear wall 34 closing the rear wall of compartment 16.

A wheel 36 having a plurality of spaced slots 38 is mounted on shaft 40 with a spacer member 42 and is journaled in housing 12 and is located between the first convexities 30 of housing 12 in compartment 16.

Slots 38 are separated by semi-circular indentations 44 formed on the rim of wheel 36.

One side of wheel 36 is provided with a plurality of spaced handle members 46. The other side of wheel 36 is provided with a driver gear 48, preferably integral with wheel 36.

Driver gear 48 interlocks with a first idler gear 50 preferably of approximately equal size, which has a spindle 52 extending through a recessed opening in housing 12 and is maintained in position by snap rings 54 on spindle 52.

First idler gear 50 interlocks with a second idler gear 56, preferably of a smaller size, which has a spindle 58 extending through a recessed opening in housing 12 and is maintained in position by snap ring 60.

The second idler gear 56 interlocks with a second driver gear 62 preferably of a similar size, which is integral with cutter wheel 64.

Cutter wheel 64 has a plurality of spaced cutters 66 mounted on the rim of cutter wheel 64 and perpendicularly to the rim of cutter wheel 64.

Cutter wheel 64, together with second driver gear 62, is mounted on shaft 68 journaled in housing 12.

A second embodiment 70 of the adhesive tape cutter has a modified housing 72 formed by two spaced side members 74 defining a compartment 76 between and joined at each end by any suitable means.

Each of side members 74 has a semi-circular portion 78 forming a front wall 79 of housing 72 with a semi-circular recess 80 formed in the interior walls of front portion 78 to accommodate a tape supply pulley 82 with spindles 84.

Each of the interior walls of front portion 78 of side member 74 has a vertical groove 86 opposite each other to permit the insertion of the tape supply pulley 82 and to provide a bearing surface for spindles 84.

In back of and adjoining the front portion 78 are concavities 88 formed in the walls of side members 74.

In back of and adjoining the concavities 88 are partial semi-circular convexities 90 formed in the walls of side members 74 which terminates with flat tops 92 and a rear wall 94, enclosing compartment 76.

A wheel 96 having a plurality of spaced slots 98 is located in compartment 76 and is mounted on shaft 100 which is journaled in housing 72.

Slots 98 are separated by semi-circular indentations 102 formed in the rim of wheel 96. One side of wheel 96 is provided with a plurality of spaced handle members 97.

The other side of wheel 96 is provided with a preferably integral cam member 104 having an outer surface contoured by a camming groove 106 formed with a plurality of alternating cam lobes 108 and cam troughs 110.

The troughs 110 are located along the axes of the slots 98 so that each slot 98 has a corresponding trough 110.

Cutter assembly 112 has an L shaped bracket 114 and fits in groove 116 recessed in housing 72 adjacent to cam member 104.

Cam follower 118, in the form of a pin or roller, is mounted at the top or inner portion of bracket 114 and rides in cam groove 106. A cutting blade 120 is mounted in the bottom portion of bracket 114 by any suitable means.

A third embodiment 122 of the adhesive tape cutter, shown in FIGS. 15–18, is similar in general construction to the second embodiment 70 but has certain modifications in structure and operation, as described below.

The slotted wheel 96 of the second embodiment 70 is modified by having a contoured cam 126 formed in its central portion with reverse lobes 128.

The cutter assembly 112 of the second embodiment 70 is modified by having a cut out portion or cavity 130 provided in the longitudinal portion of L shaped bracket 114 to receive a spring 132. The outer end 134 of spring 132 is secured to a recessed slot 136 formed in housing 72 and the inner end 138 is secured to the L shaped bracket 114 by an anchor pin 140 inserted through opening 142 in the bracket 114. The cam follower 118 is congruent separately with the lobes 128 in the cam surface 144.

Figure 2:
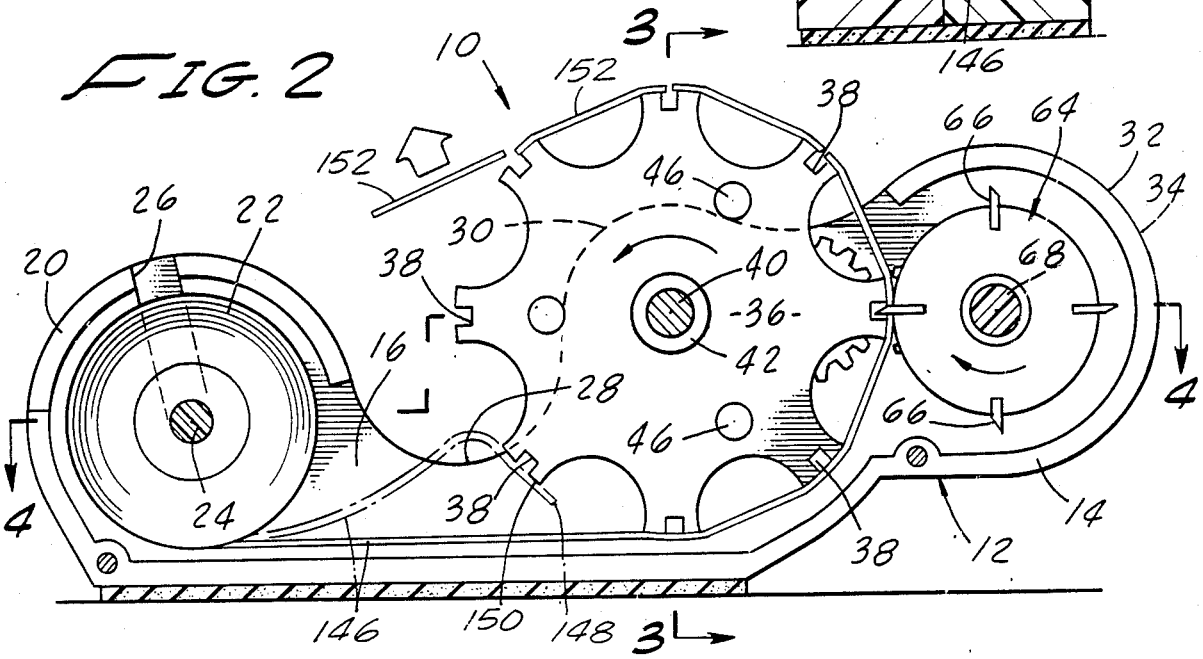
FIG. 2 is a side elevational cross section taken on lines 2—2 of FIG. 1.
Figure 15:
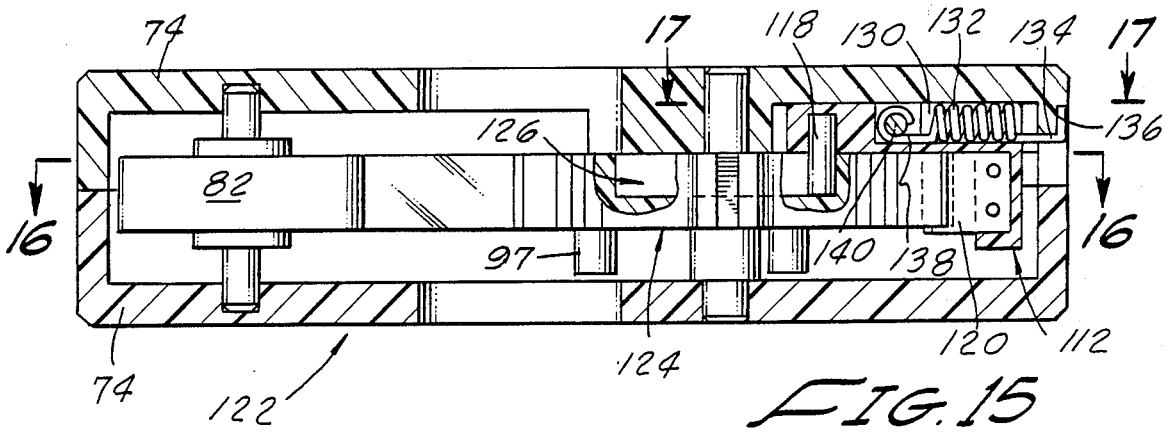
FIG. 15 is a plan cross sectional view of a third embodiment of the invention.
Figure 16:
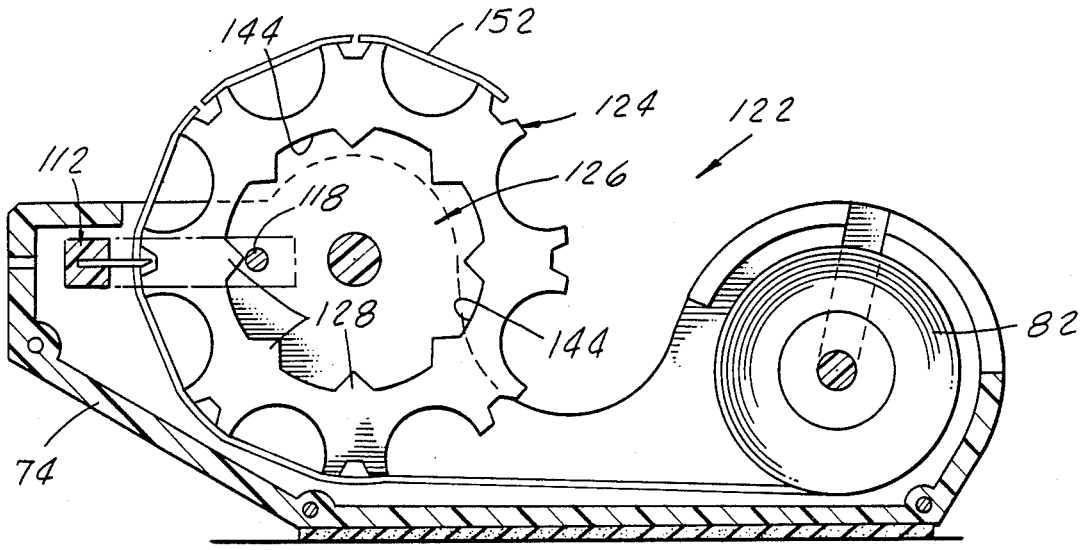
FIG. 16 is a side elevational cross section taken on lines 16—16 of FIG. 15.
Figure 17:
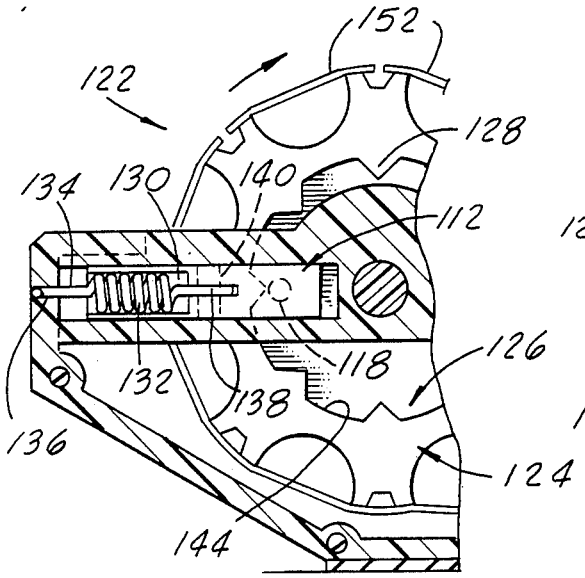
FIG. 17 is a fragmentary side elevational cross section taken on lines 17—17 of FIG. 15.
Figure 18:
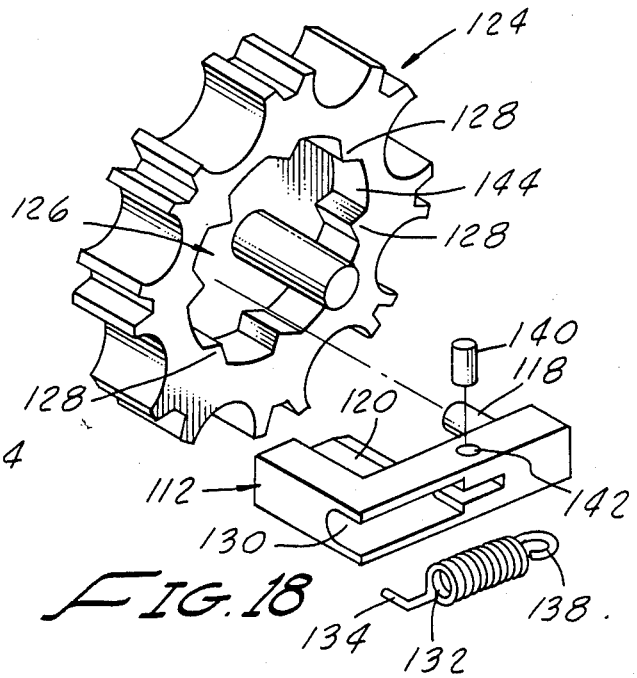
FIG. 18 is an exploded perspective of the cutting means of the cutter assembly of FIGS. 15 through 18.

In the operation of the first embodiment 10 of the invention, a tape supply wheel 22 having adhesive tape 146 thereon, is inserted into grooves 26 of the housing 12. The leading edge 148 of the tape 146 is pulled manually into contact with the surface 150 of one of the slots 38 of slotted wheel 36, as shown in FIG. 2.

One of the handles 46 of slotted wheel 36 is then rotated counterclockwise, which rotates wheel 36 counterclockwise also, and brings more of the tape 146 into contact with the other slot 38 and slotted surfaces 150 of wheel 36. The tape 146 also stretches over and covers the indentations 44 of slotted wheel 36.

Further rotation of wheel 36 brings the tape 146 into contact with one of the cutters 66 of cutter wheel 64, which is being rotated clockwise as slotted wheel 36 rotates counterclockwise, due to the coaction of driver gears 48 and 62, and idler gears 50 and 56.

Continued rotation of slotted wheel 36 causes the cutters 66 of cutter wheel 64 to impinge upon and cut the portion of the tape 146 above the slot 38. As the cutter blade 66 cuts the tape 146, each enters into a slot 38 of slotted wheel 36.

After being cut, the pieces or lengths 152 of tape 146 remain in position, covering the indentations 44 of slotter wheel 36.

Continued further rotation of slotted wheel 36 brings the cut pieces 152 of the tape 146 towards the tape supply wheel 22. In this position, a person's finger may be inserted in the space between the bottom surface of the cut tape pieces 152 and the surface of an indentation 44, to lift up and remove the cut length of tape.

In the operation of the second embodiment, the steps of insertion of the tape supply wheel 82 having adhesive tape 146 thereon, and the rotation of slotted wheel 96 are accomplished in a manner similar to the operation of the first embodiment.

The cutting operation for the second embodiment takes place by the action of cam member 104.

As slotted wheel 96 continues to rotate, cam follower 118 in cam groove 106 causes cutter assembly 112 to move toward a slot 98 in slotted wheel 96, whereby cutting blade 120 impinges upon and cuts the tape 146 at slot 98.

Further rotation of wheel 96 causes cam follower 118 to push cutter assembly 112 backward and away from the rim of wheel 96. Continued further rotation of wheel 96 thereafter, will produce a repetition of the cutting operation.

The cut pieces 152 of adhesive tape 146 are removed in the same manner as in the operation of the second embodiment 70.

In the operation of the third embodiment 122, the operative steps are the same as for the second embodiment 70, except for the manner in which the cutter assembly 112 performs the cutting operation.

As slotted wheel 124 rotates, cam follower 118 moves back and forth towards and away from the center of wheel 124, as it follows the reverse lobes 128, and cam surface 144 of cam 126, which rotates together with slotted wheel 124.

The backwards movement of cam follower 126 expands spring 132 and pulls cutter assembly 112 towards the center of wheel 124 so that cutter blade 120 impinges upon and cuts the adhesive tape 146 at the slot 136.

Upon further rotation of slotted wheel 124, cam follower 118 moves away from the center of wheel 124, and spring 132 then pulls the cutter assembly 112 back, so that cutting blade 120 is removed from slot 136.

The lengths or pieces 152 of adhesive tape 146 cut in the operation of the third embodiment 122 are removed in the same manner as in the first and second embodiments.

In the first embodiment 10, of the invention, a preferable ratio between the radius of slotted wheel 36 and cutter wheel 64 is 1:2. The corresponding ratio between the circumference $C_1$ of slotted wheel 36 to the circumference $C_2$ of cutter wheel 62 is also 1:2.

The number of the cut pieces of adhesive tape will be $C_1/C_2^n$, where n is the number of blades of the cutter wheel 64, and the approximate length of the cut pieces 152 of adhesive tape 146 will be $C_1/n$.

With respect to the first embodiment, a preferable ratio between first driver gear 48 and first idler gear 50, and second idler gear 56 and second driver gear 62, can be expressed by their respective radii in conjunction with the radii of slotted wheel 36 and cutter wheel 64 as follows:

$R_1$ = the radius of slotted wheel 36

$R_2$ = the radius of cutter wheel 64

$R_3$ = the radius of first driver gear 48 and also the radius of first idler gear 50

$R_4$ = the radius of second idler gear 56 and also the radius of second driver gear 62

The ratios can be reduced to the following formulae:

$$R_3 + 2R_3 = R_1 \qquad R_4 + 2R_4 = R_2$$

$$3R_3 = R_1 \qquad 3R_4 = R_2$$

$$\frac{R_3}{R_4} = \frac{R_1}{R_2}$$

Although I have described my invention in detail with reference to the accompanying drawings illustrating the preferred embodiments of my invention, it is understood that numerous changes in the details of construction and arrangement of parts may be made without departing from the spirit and scope of the invention as hereinafter claimed.

I claim:

1. An adhesive tape cutter device comprising a housing having spaced apart side walls, means for rotatably supporting a roll of tape between said side/walls adjacent one end of the housing, means unrolling tape from the roll of tape, said means for unrolling tape comprising a slotted wheel rotatably supported between said side walls and adjacent roll of tape, said slotted wheel having a plurality of projections uniformly spaced on the periphery, each projections include a pair of tape contacting faces spaced apart by a slot on the periphery which are progressively contact the tape to unroll the tape from the roll, cutting means including a bladed wheel located rotatably between said side walls adjacent the slotted wheel and adjacent the other end of the housing, said bladed wheel having a plurality of cutter blades on it periphery which project into said slots ink said projections on said slotted wheel in use to cut the unrolled tape on said projections, a first gear secured to said slotted wheel, a second gear secured to said bladed wheel, said gears rotate with said wheels, said gears being smaller said wheels, and two intermeshed idler gears rotatably supported between said side walls and between said first and second gears, one idler gear intermeshed with the slotted and the other idler gear intermeshed with the bladed wheel, whereby the four gears are intermeshed and rotation of the slotted wheel rotates the bladed wheel and the cutter blades move into the slots of said projection and cut the tape thereon.

* * * * *